US005931704A

United States Patent [19]

Johnson et al.

[11] Patent Number: 5,931,704

[45] **Date of Patent: *Aug. 3, 1999**

[54] MEDIA CONNECTOR INTERFACE WITH TAPERED CONTACT WIRES FOR USE WITH A THIN-ARCHITECTURE COMMUNICATIONS CARD

[75] Inventors: Thomas A. Johnson, Draper; W. Duane Burge, Riverton; Brent D. Madsen, Providence, all of Utah

[73] Assignee: 3Com Corporation, Santa Clara, Calif.

[ * ] Notice: This patent is subject to a terminal disclaimer.

[21] Appl. No.: 08/808,508

[22] Filed: Feb. 27, 1997

[51] Int. Cl.[6] ..... H01R 23/02

[52] U.S. Cl. ..... 439/676; 439/946

[58] Field of Search ..... 439/676, 344, 439/638, 946, 946.2, 862, 941, 655, 55, 131; 29/884

[56] References Cited

U.S. PATENT DOCUMENTS

| | | | |
|---|---|---|---|
| 4,428,636 | 1/1984 | Kam et al. | 439/676 |
| 4,460,234 | 7/1984 | Bogese | 439/676 |
| 5,547,405 | 8/1996 | Pinney et al. | 439/676 |
| 5,727,972 | 3/1998 | Aldous et al. | 439/946 |
| 5,791,947 | 8/1998 | Crane, Jr. et al. | 439/862 |

*Primary Examiner*—Paula Bradley
*Assistant Examiner*—Tho D. Ta
*Attorney, Agent, or Firm*—Workman, Nydegger & Seeley

[57] ABSTRACT

A communications card capable of being mounted in electrical communication with a computer has formed therethrough an aperture so sized and shaped as to be capable of receiving a physical/electrical media connector. A plurality of contact wires are disposed in the aperture. The contact wires have a tapered section formed thereon for preventing embedding and damage to the contact wires caused by plugging and unplugging the physical/electrical media connector in the aperture. The contact wires also have a remote end that is substantially rounded. The cross-section of the media connector is greater than the thickness of the communication card. The physical/electrical media connector also has a biased retention clip, a contact pin block, and contact pins. The retention clip has several standardized characteristics including a broad fixed end protruding from an outer surface of the contact pin block. The broad fixed end tapers abruptly at a transition notch down to a narrow free end, capable of being manipulated by a user to remove the physical/electrical media connector from the aperture in the communications card. In use, a physical/electrical media connector is inserted directly into the aperture in the communications card, the aperture being in contact with a plurality of contact wires fixed within the communications card. The aperture is formed either within the communications card itself, or within an aperture block in electrical communication with the communications card.

27 Claims, 4 Drawing Sheets

MEDIA CONNECTOR INTERFACE WITH TAPERED CONTACT WIRES FOR USE WITH A THIN-ARCHITECTURE COMMUNICATIONS CARD

BACKGROUND

1. The Field of the Invention

The present invention relates to a direct communication interconnect system. More particularly, the present invention relates to an interface between a connector and a communications card in a computer system.

2. Related Technology

A. Data Transmission

The field of transmission of data by phone lines or network cables is a rapidly expanding field. Users of personal computers in particular are finding such practice to be of great value.

For example, there are numerous public and private networks and databases which store data or programs. Absent the ability to send and receive data over telephone lines through a modem, a user is relegated to relying upon the exchange of discs or tapes in order to receive data suitable for use with their computer.

Similarly, companies performing tasks that are integrated are aided by local area networks ("LANs") which permit personnel to exchange electronically retrievable data. The ability to freely transfer data and information from one computer to another computer over a telephone line may dramatically increase productivity and reduce overall production time.

To translate the binary code utilized by a computer into signals capable of being transmitted over the telephone lines, modems have been developed to translate and reconfigure binary signals into analog signals capable of being transmitted over telephone lines. For conversion of signals to take place, a modem must be placed between the computer generating the binary signals and the telephone line capable of carrying the analog signals.

Typically, in today's practice, a modem at the transmitting computer end of a telephone line receives binary digital data from the computer and converts the binary code received from the computer into modem frequency signals. These modem frequency signals are then transmitted over the telephone lines to a receiving modem at the receiving computer.

The modem at the recipient's end then converts the modem frequency signal back to binary digital data characters and inputs the data characters to the input port of the receiving computer.

The ubiquity of the telephone and the need for interactive systems throughout the world have caused standards to be established for the components of a telephonic system. Standardization allows telephone systems and devices using those systems to be interchangeable. The components of the telephone that are most thoroughly standardized are physical/electrical media connectors.

Physical/electrical media connectors are used by almost all telephone companies throughout the world for many applications, the most important of which is interconnection of telephones with telephone lines. For this reason, stringent standardization of connectors is required if compatibility and interactivity is to be realized.

One popular physical/electrical media connector used in the United States of America is the RJ-11 6-position miniature modular plug physical/electrical media connector. The RJ-11 is used between the telephone line and the telephone itself.

Unfortunately, because of the physical and electrical differences between the many pins of the peripheral ports associated with the central processing unit of a computer and the 6 pins of the RJ-11, direct physical or electrical connection of the RJ-11 to the computer is not possible.

Consequently, it has been found necessary to employ modems or similar input/output devices or cards to effect communication between computers and telephone lines. Modems reconfigure binary data from the central processing unit of the computer as received through the multi-pin peripheral port. The reconfigured data is then transmitted in analog form through the RJ-11 physical/electrical media connector into the telephone line.

A problem associated with a communication card capable of direct communication with a miniature modular plug physical/electrical media connector as well as with traditional standard connectors, however, is that upon plugging and unplugging of the media connector, the contact wires of the socket within the card sometimes become embedded or misaligned with the alignment comb structure of the plug. Inserting the plug into the socket or removing the plug from the socket can bend or even irreparably damage the contact wires.

This problem is further compounded by the variation among different manufacturers of the plug. Some plugs have excessive draft angle on the sides of the alignment comb structure. The draft angle makes the bottom of the alignment comb structure narrower than the top of the alignment comb structure. The draft angle and the variability of the plugs increases the occurrence of bent or damaged contact wires.

Attempts have been made to remedy the problem by putting a radius on the end of the contact wires. The ends of the wires, however, still snag or embed on the sides of the alignment structure of the plug and were bent, broken or otherwise irreparably damaged. It would, therefore, be an advancement in the art to provide a communications card capable of direct connection with a physical/electrical media connector that has electrical contact wires that will not so easily become embedded or snagged in the alignment comb structure of a media connector.

OBJECTS AND BRIEF SUMMARY OF THE INVENTION

It is an object of the present invention to provide a direct communication interconnect system comprising a physical/electrical media connector with electrical contact wires that will not become embedded or damaged in the alignment comb structure of the plug of the physical/electrical media connector.

Another object of the present invention is to provide electrical contact wires that can be incorporated into any direct communication interconnect system that will not become embedded in the alignment comb structure of the plug and can withstand repeated connection and disconnection without being damaged or bent.

Another object of the present invention to provide a communications card capable of direct connection with a miniature modular plug physical/electrical media connector with electrical contact wires that will not become embedded in the alignment comb structure of the plug.

Another object of the present invention is to provide a communications card capable of direct connection with a physical/electrical media connector with electrical contact wires that can accommodate the variability of the alignment comb structure of media connectors produced by various manufactures without becoming embedded or damaged during repeated connection and disconnection of the media connector.

Another object of the present invention is to provide a direct media connector interface for use in laptop, notebook, palmtop, desktop, or Personal Digital Assistant (herein after PDA) computers that can be repeatedly connected and disconnected without damaging or bending the electrical contact wires in the alignment comb structure of the media connector.

Another object of the present invention is to provide a direct media connector interface for use in laptop, notebook, palmtop, desktop, or PDA computers with contact wires that will not be damaged by repeated plugging and unplugging of the media connector and does not displace contiguous memory cards.

Yet another object of the present invention is to provide a communications card that complies with the a thin-architecture memory card space configuration limitations while also providing direct connection with a miniature modular plug physical/electrical media connector and includes contact wires capable of withstanding repeated connecting or disconnecting of the media connector.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, an interface for use between a physical/electrical media connector and a communications card, such as a thin-architecture communication card used in laptop, notebook, palmtop, desktop, or PDA computers, is provided.

The physical/electrical media connector (such as an RJ-11) capable of being used with the present invention has a biased retention clip, a contact pin block, and contact pins. The retention clip has several standardized characteristics, including a broad fixed end protruding from an outer surface of the contact pin block. The broad fixed end tapers abruptly at a transition notch to a narrow free end. A user manipulates the narrow free end to disengage the media connector from the communications card.

In use, a media connector (such as an RJ-type, or a 6 or 8-pin miniature modular plug) is inserted directly into an aperture in a communications card having a plurality of contact wires disposed therein that are in electrical connection with both the computer and the aperture. This direct connection obviates the need for any adapters to facilitate connection of the media connector to the communications card.

The inventive contact wires comprise a guide means for preventing embedding and damage to the contact wires caused by plugging and unplugging the physical/electrical media connector in the aperture.

In one embodiment, the guide means comprises a tapered section formed over the length of the contact wires extending into the aperture. The guide means further comprises the remote end of the contact wires being substantially rounded. The guide means prevents the contact wires from being embedded, bent or damaged by the plugging and unplugging of the physical/electrical media connector in the aperture block.

The aperture is sized and configured so as to be capable of receiving the media connector. The orientation of the aperture to the communications card is important as the contact wires must be in electrical contact with the contact pins in the media connector to properly communicate electrical signals therethrough.

Embodiments utilize a variety of structures to exert an opposing force on the media connector as it is inserted to the aperture. The aperture is configured to capture the biased retention clip. The captured biased retention clip and the opposing force serve to hold the media connector in place.

Other embodiments of the present invention utilizes an aperture formed perpendicular to the surface of the communications card. Complete passage through the aperture is prevented by a depending stirrup blocking the travel of the contact pin block completely through the aperture. Unlike other embodiments utilizing angles other than perpendicular, this embodiment overcomes the depth restrictions of the thin-architecture communications architecture by allowing the contact pin block to protrude below the plane of the lower surface of the communications card to a point where it is captured by the depending stirrup and prevented from further travel. Structures formed in the aperture such as a retention ridge capture the biased retention clip and hold the physical/electrical media connector in electrical communication with the retractable aperture block of the communications card.

It will be appreciated that this technology may be similarly implemented into full sized computers and communications cards which have an enclosed socket for receipt of the media connector. Likewise, the tapered contact wires may be utilized in any socket into which repeated connection is made.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying wings in which.

DETAILED DESCRIPTION OF THE PREFERRED EMBODIMENTS

Figure 1:
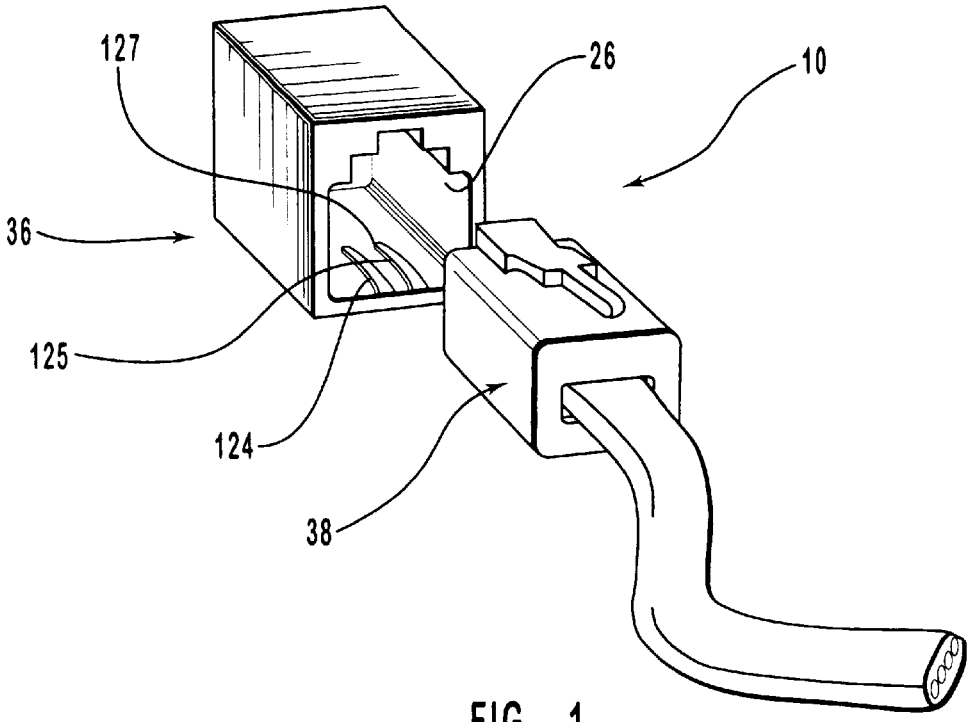
FIG. 1 is a perspective view of a direct communications interconnect system with one embodiment of contact wires having a tapered section incorporated therein.

The present invention relates to a direct communication interconnect system that in broad terms includes a physical/electrical media connector 10 comprising a socket 36 and a plug 38 illustrated in FIG. 1. Socket 36 is in electrical communication with whatever piece of equipment it is disposed in or attached to Socket 36 comprises an aperture 26 capable of receiving plug 38. Socket 36 also comprises contact wires 124.

According to one aspect of the present invention, contact wires 124 comprise a guide means for preventing embedding and damage caused by plugging and unplugging physical/media connector 10. One embodiment of structure capable of performing the function of such a guide means comprises contact wires, such as contact wires 124, with a tapered section 125 as illustrated in FIG. 1. Other configurations of tapered section 125 on contact wires 124 are also equally effective in carrying out the intended function thereof. In this embodiment, contact wires 124 have a remote end 127 disposed in socket 36.

Guide means further comprises remote end 127 of contact wires 124 being substantially rounded. In one embodiment of contact wires 124 shown in FIG. 1, tapered section 125 extends over the length of contact wires 124. A generous radius has been made on remote end 127 of contact wires 124. Various embodiments of guide means are equally effective in carrying out the intended function thereof.

It can be appreciated that the present invention can be utilized in any socket or direct communication interconnect system such as socket 36 into which repeated connection is made. This technology may similarly be implemented into full-sized computers and communication cards which have an enclosed socket for receipt of the physical/electrical media connector.

The majority of the features previously discussed apply to a direct communication interconnect system. The features that are not affected are identified with the same reference numbers as used in FIG. 1. Only those features that have changed will be described in detail.

Figure 2:
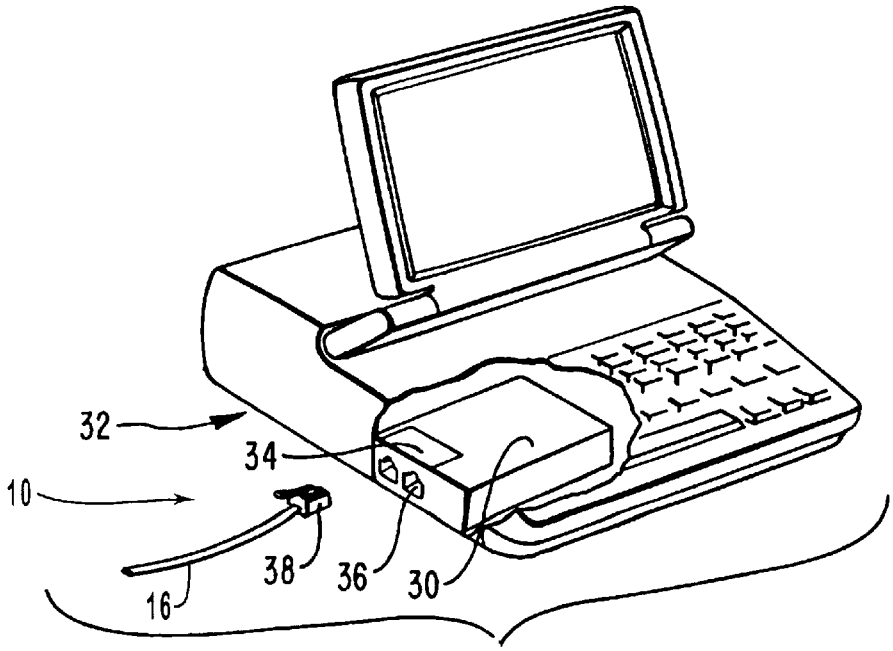
FIG. 2 is a perspective view of an integral modem installed in a portable computer.

FIG. 2 illustrates one application of the present invention as incorporated into a computer. An integral internal modem 30 is located within the housing of a portable computer 32 at a position giving access to telephone line 16. The interface between telephone line 16 and modem 30 is achieved in one embodiment through the use of physical/electrical media connector 10, such as an RJ-11 physical/electrical media connector, and an internal digital access arrangement (DAA) 34.

Socket 36, such as a RJ-11 socket, is formed in the housing of computer 32. Socket 36 is capable of receiving plug 38, such as a R-11 plug, from any of the many telephone lines utilizing an RJ-11 physical/electrical media connector system.

Figure 3:
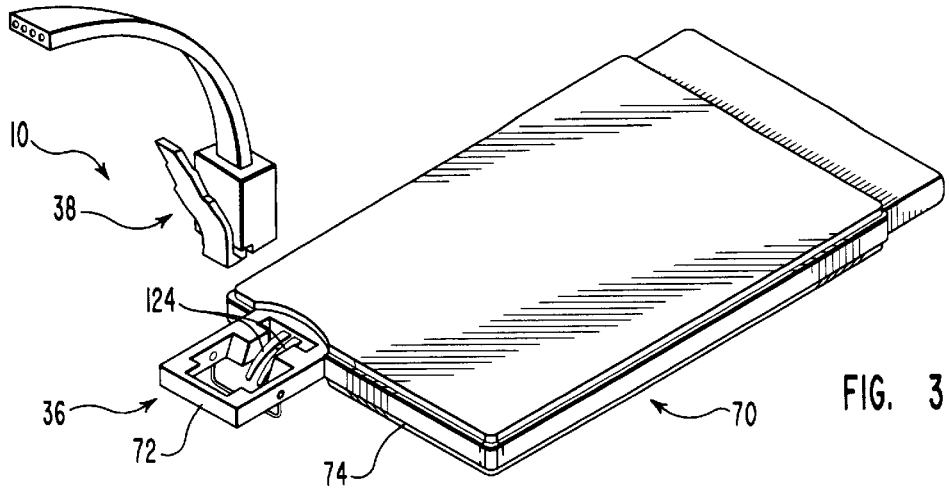
FIG. 3 is a perspective of one embodiment of a retractable aperture block with one embodiment of contact wires with a tapered section.

Physical/electrical media connector 10 comprises plug 38 and socket 36. Socket 36 comprises aperture block 72 which in this embodiment is retractable into fixed portion 74. FIG. 3 illustrates a communications card 70 having an aperture block 72 and a fixed portion 74. Fixed portion 74 is in electrical connection to aperture block 72 and a computer (not shown). This figure illustrates, generally, one system for achieving direct connection to a physical/electrical media connector 10 with a communications card 70.

Figure 4:
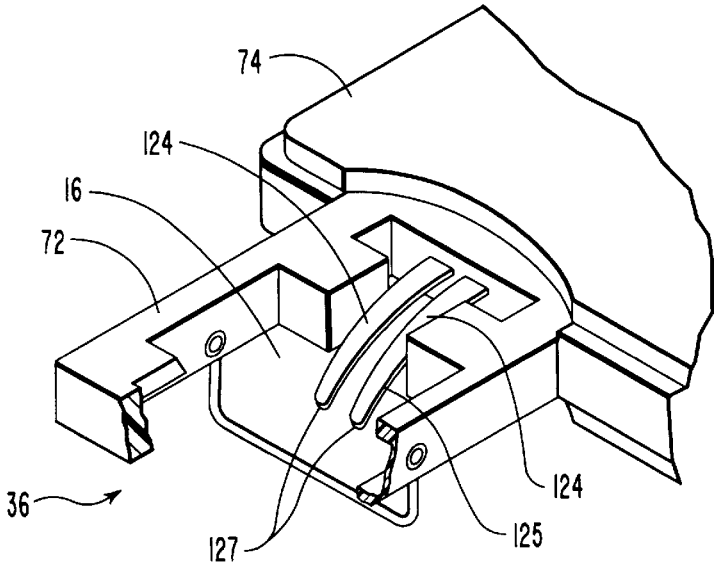
FIG. 4 is an enlarged perspective view of the retractable aperture block from FIG. 3 showing one embodiment of contact wires with a tapered section.

FIG. 4 is an enlarged view of the embodiment of aperture block 72 illustrated in FIG. 3. Aperture block 72 comprises aperture 26 in which contact wires 124 extend. An aperture block, such as retractable aperture block 72 shown in FIGS. 3 and 4, includes contact wires 124. According to one aspect of the present invention, contact wires 124 comprise a guide means for preventing embedding and damage caused by plugging and unplugging plug 38 of physical/electrical media connector 10 in aperture block 72 of socket 36.

One embodiment of structure capable of performing the function of such a guide means comprises contact wires such, as contact wires 124 with a tapered section 125, as illustrated in FIG. 4. In this embodiment contact wires 124 further comprise a remote end 127 disposed in the aperture. Guide means further comprises remote end 127 of contact wires 124 being substantially rounded. Various embodiments of guide means are equally effective in carrying out the intended function thereof.

In the embodiment of contact wires 124 shown in FIG. 4, tapered section 125 extends over the length of contact wires 124. Other configurations of a tapered section on contact wires 124 are also equally effective in carrying out the intended function thereof. By way of example and not limitation, tapered section 125 can extend from remote end 127 over only a portion of contact wires 124 rather than over the entire length of contact wires 124 as illustrated in FIG. 4.

Other potential embodiments of guide means include a tapered section comprising a cylindrical contact wire that is actually slightly conical in shape and is narrowest at the remote end of the contact wire and widens towards the communication card. The remote end of the contact wire is substantially rounded. The tapered section may extend the entire length of the contact wire or a portion thereof.

Another embodiment of guide means may include a contact wire, such as contact wires 124, with tapered section 125 on all the surfaces of contact wire. This results in remote end 127 of contact wires 124 being very thin. The amount of tapering is limited by the strength of the material comprising contact wires 124. As with the other embodiments, the tapered section may extend over the entire length of contact wires 124 or any portion thereof.

Figure 5:
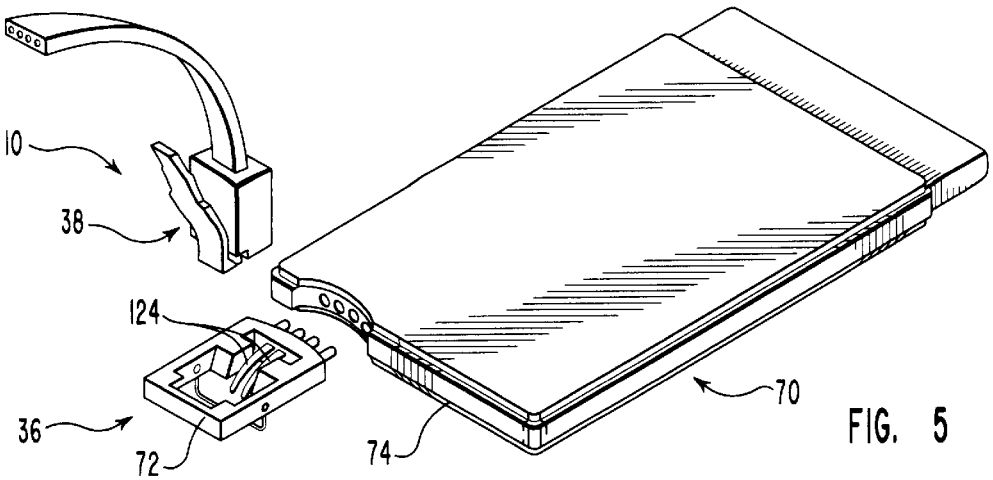
FIG. 5 is a perspective of one embodiment of a detachable aperture block showing one embodiment of contact wires with a tapered section.
Figure 6:
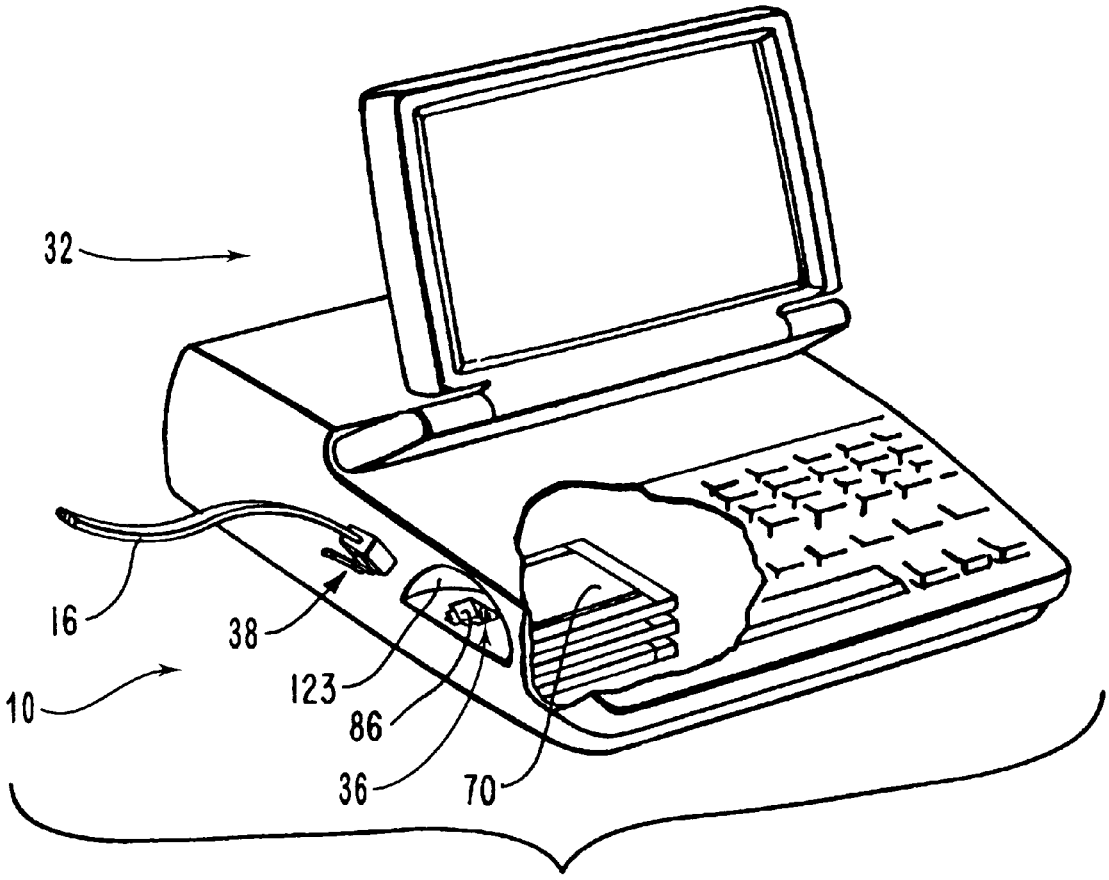
FIG. 6 is a perspective view of a computer housing formed so as to reveal the communications card installed therein.
Figure 7:
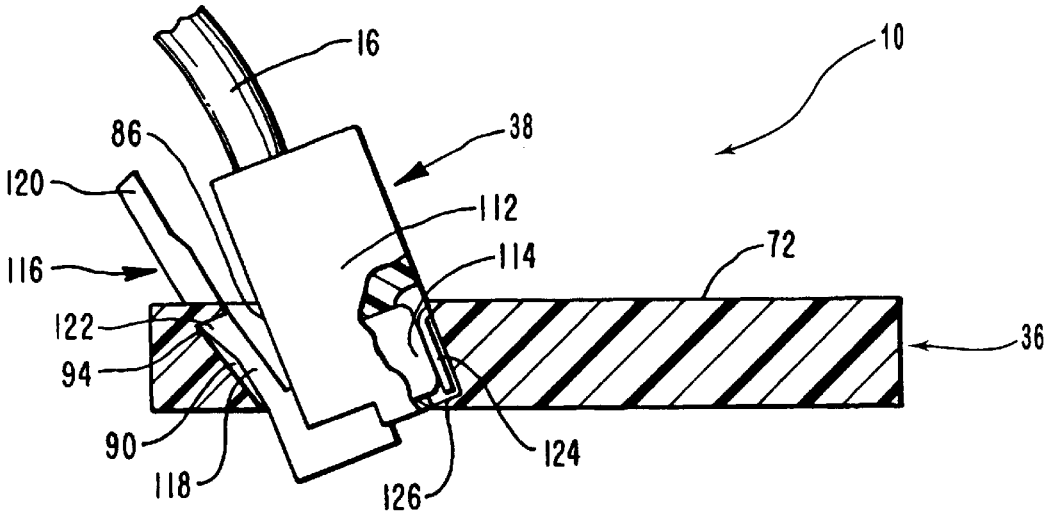
FIG. 7 is a partially broken-away cross-sectional view of an aperture block of an thin-architecture communications card having a physical/electrical media connector inserted therein.
Figure 8:
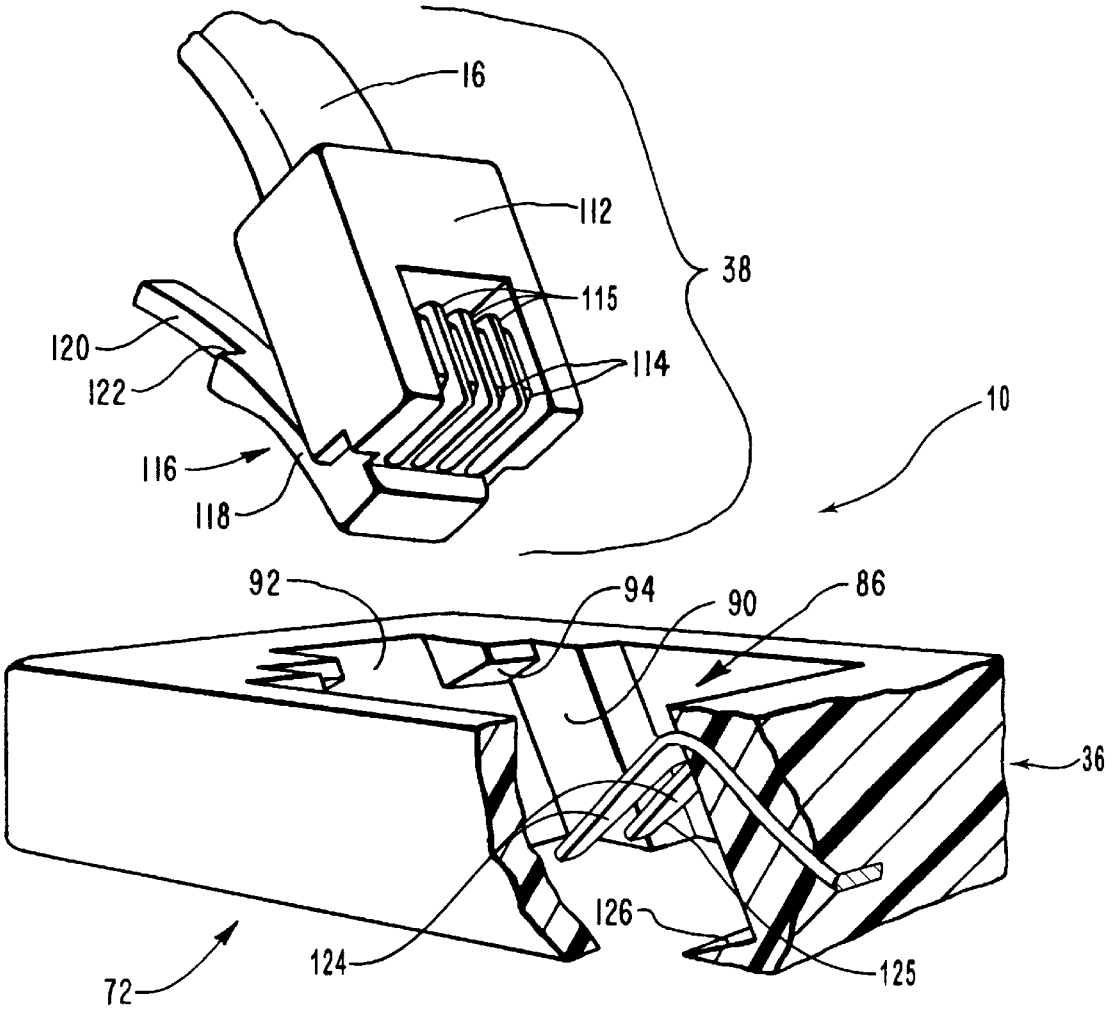
FIG. 8 is a partially broken away perspective view of an aperture block of an thin-architecture communications card and a physical/electrical media connector disconnected therefrom.

Contact wires 124 with tapered section 125 may be incorporated into other embodiments of aperture block 72 such as, by way of example, the detachable aperture block illustrated in FIG. 5 or various other embodiments of socket 36 of physical/electrical media connector 10, illustrated in FIGS. 6–8.

Tapered section 125 prevents contact wires 124 from becoming bent or embedded in the alignment comb structure of plug 38 of physical/electrical media connector 10. The interaction of plug 38 of physical/electrical media connector 10 and aperture block 72 of socket 36 as well as the detailed structure of physical/electrical media connector 10 will be discussed further relative to FIGS. 7 and 8.

FIG. 5 illustrates a thin-architecture communications card 70 also having aperture block 72 and fixed portion 74. In this embodiment, aperture block 72 of socket 36 is detachable from fixed portion 74. This is another general system for achieving direct connection to a physical/electrical media connector 10 with a thin-architecture communications card 70. Detachable aperture block 72 is in electrical connection with fixed portion 74 when attached. Fixed portion 74 is in electrical connection with a computer (not shown). As used in this application, the term aperture block refers to either an aperture block that is retractable as depicted in FIG. 3, or an aperture block that is detachable as depicted in FIG. 5. In the absence of any specific designation, the term aperture block should be construed throughout this application to include either or both retractable and detachable functions.

Aperture block 72 illustrated in FIG. 5 comprises, by way of example and not limitation, contact wires 124 with tapered section 125 like the embodiment illustrated in FIG. 4.

FIG. 6 depicts the computer housing having formed therein an access tunnel 123. Access tunnel 123 allows direct access to communications card 70 from outside of the computer without the need to move communications card 70. Plug 38 of physical/electrical media connector 10 is inserted through access tunnel 123 directly into communications card 70 to provide a physical and electrical connection between computer 32 and telephone line 16.

FIG. 7 depicts an inventive interface between plug 38 and aperture block 72 of socket 36 of physical/electrical media connector 10. An aperture block, such as aperture block 72, may be retractable or detachable, or may be formed within the communications card itself, and is not a limitation in this, or the subsequent embodiments discussed. In addition, the interaction between plug 38 and aperture block 72 of socket 36 is substantially the same regardless of whether aperture 86 in aperture block 72 is at an angle as illustrated in FIG. 7 or perpendicular to the communications card as illustrated in FIGS. 2 and 6.

As shown in FIGS. 7 and 8, plug 38 of physical/electrical media connector 10 comprises a contact pin block 112, a plurality of contact pins 114, and a biased retention clip 116. Contact pin block 112 comprises an alignment comb structure 115. Contact pins 114 are disposed between each upwardly extending portion of alignment comb structure 115. Upon insertion of plug 38 of physical/electrical media connector 10 contact wires 124 enter alignment comb structure 115. As plug 38 of physical/electrical media connector 10 is plugged into aperture block 72 of socket 36 contact wires 124 enmesh with alignment comb structure 115 and resiliently deflect against contact pins 114. An electrical connection is then formed between a telephone line 16 and aperture block 72. The biased retention clip of plug 38 of physical/electrical media connector 10 comprises a broad fixed end 118, a narrow free end 120, and a transition notch 122.

The communications card in FIG. 7 may also be provided with means for preventing passage of the contact pin block completely through the aperture in the communications card. By way of example, the passage prevention means of the embodiment illustrated in FIG. 7 comprise a ledge 126.

FIG. 8 illustrates an embodiment of plug 38 of physical/electrical media connector 10, such as a conventional RJ-11 plug, located near aperture block 72 of socket 36 of physical/electrical media connector 10. Within operative 86 is formed a broad retention clip groove 90, a narrow retention clip groove 92 and a retention ridge 94. When inserted, as illustrated in FIG. 7, RJ-11 plug 38 initiates electrical connection between contact wires 124 and contact pins 114 to allow the transfer of data from telephone line 16 to the computer. Ledge 126 prevents passage of RJ-11 plug 38 entirely through aperture block 72 of communications card 70.

One embodiment of contact wires, such as contact wires 124 shown in FIG. 8, have tapered portion 125 extending the exposed length of contact wires 124 to aid in preventing embedding and damage to contact wires 124 caused by plugging and unplugging plug 38 of physical/electrical media connector 10 in aperture block 72 of socket 36. Tapered portion 125 enables contact wires 124 to smoothly enmesh in the alignment comb structure 115 of plug 38 of physical/electrical media connector 10, such as the RJ-11 plug shown in FIG. 8. Remote end 127 of contact wires 124 has a generous radius thereon resulting in contact wires 124 being substantially rounded which assists in preventing embedding and damage to contact wires 124 caused by plugging and unplugging plug 38 in aperture block 72 of socket 36 of physical/electrical media connector 10. Both tapered section 125 and remote end 127 of contact wires 124 also aid in contact wires 124 cleanly enmeshing with alignment comb structure 115 of contact pin block 112 and forming an electrical contact.

There are various manufacturers of physical/electrical media connector 10. Some of the designs of plugs 38 of physical/electrical media connector 10, such as a RJ-11 plug, have a larger draft angle on the sides of alignment comb structure 115. The draft angle makes the bottom of alignment comb structure 115 near contact pins 114 narrower than the top of alignment comb structure 115. Prior to the present invention, contact wires 124 often snagged and became embedded in alignment comb structure 115 or were bent or damaged upon insertion or removal of plug 38 of physical/electrical media connector 10. In addition, the variations between physical/electrical media connectors 10 made by different manufacturers often causes contact wires 124 to embed or bend in alignment comb structure 115. In some cases in either situation contact wires 124 are irreparably damaged.

Contact wires, such as contact wires 124 with tapered section 125, are capable of accommodating the variations in alignment comb structure 115 as well as preventing the problems caused by snagging or embedding in the sides of alignment comb structure 115 even where alignment comb structure 115 has excessive draft angle on the sides thereof. Tapered section 125 eliminates bending, breaking or other irreparable damage occurring during connecting or disconnecting physical/electrical media connector 10. In one embodiment of contact wires 124 with tapered section 125 a generous radius was added to remote end 127 to further reduce the problem of embedding, snagging, bending or misalignment causing other irreparable damage of contact wires 124.

Contact wires 124 with tapered section 125 also reduces the cross-section moment of inertia of contact wires 124 over the length thereof when contact wires 124 are placed under stress upon plug 38 of physical/electrical media connector 10, such as RJ-11 plug 38, being inserted into aperture block 72 of socket 36 of physical/electrical media connector 10. This in turn reduces the stress and strain of contact wires 124 where contact wires 124 cantilever out of aperture block 72 and distributes the stress and strain over the length of contact wires 124. Prior contact wires had the stresses caused by inserting the plugs of the physical/electrical media connector into the aperture block of the socket concentrated in the area of the contact wires where they cantilever out of the aperture block.

The physical connection of RJ-11 plug 38 into angled aperture 86 is guided by the insertion of broad fixed end 118 into broad retention clip groove 90 of angled aperture 86. Progress of broad fixed end 118 through broad retention clip groove 90 are not impeded. However, once narrow free end 120 of biased retention clip 116 is pressed beyond retention ridge 94, RJ-11 plug 38 is locked within angled aperture 86.

To release RJ-11 plug 38 from angled aperture 86, a user merely presses biased retention clip 116 at narrow free end 120 toward contact pin block 112 and withdraws RJ-11 plug 38 from angled aperture 86. Transition notch 122 interacts with retention ridge 94 to lock RJ-11 plug 38 into angled aperture 86 when engaged.

It will be appreciated that aperture 86 formed in aperture block 72 is not required to be at an angle. Aperture 86 may have the configuration as a perpendicular aperture within aperture block 72 that plug 38 of physical/electrical media connector 10 is inserted to and will be equally effective in carrying out the intended function thereof.

It will also be appreciated that this technology and particularly contact wires having a tapered section may be implemented into any socket into which repeated connection is made.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States patent is:

1. A communication card having electrical components for use in connecting a computer to a physical/electrical media connector of a communications system, the communications card comprising:

(a) an upper surface;

(b) a lower surface opposing said upper surface, the electrical components of the communications card being positioned between the upper surface and the lower surface;

(c) a plurality of side walls connecting said upper surface and said lower surface;

(d) an aperture formed in the communications card, said aperture extending into the communications cards, said aperture being sized and configured so as to directly receive at least a portion of the physical/electrical media connector to connect the physical/electrical media connector to the communications card; and (e) a plurality of contact wires disposed in the aperture, the contact wires forming an electrical connection between the communications card and the physical/electrical media connector when the physical/electrical media connector is disposed in the aperture, the contact wires having an initial contact surface and a remote end, the initial contact surface being broader than the remote end, thereby preventing embedding and damage to the contact wires caused by plugging and unplugging the physical/electrical media connector in the aperture.

2. A communications card for use in a computer as recited in claim 1, wherein the communications card is a local area network card.

3. A communications card for use in a computer as recited in claim 1, wherein the communications card is a modem card.

4. A communications card for use in a computer as recited in claim 1, wherein the contact wires comprise a tapered section formed on the contact wires for preventing embedding and damage to the contact wires.

5. A communications card for use in a computer as recited in claim 4, wherein the contact wires have a length and the tapered section of the contact wires extend over a portion of the length thereof.

6. A communications card for use in a computer as recited in claim 4, wherein:

(a) the contact wires comprise the remote end disposed in the aperture; and (b) the contact wires further comprise the remote end of the contact wires being substantially rounded.

7. A communications card having electrical components and with internal data access arrangement circuitry for use in connecting a downsized computer to a physical/electrical media connector of a communications system, the communications card comprising:

(a) an upper surface;

(b) a lower surface, the lower surface being separated from the upper surface by a distance smaller than a cross-section of the physical/electrical media connector, the electrical components of the communications card being positioned between the upper surface and the lower surface;

(c) a detachable aperture block capable of being physically and electrically connected to the communications card, the detachable aperture block being devoid of any data access arrangement circuitry;

(d) an aperture formed in the detachable aperture block, the aperture being sized and configured so as to directly receive at least a portion of the physical/electrical media connector to connect the physical/electrical media connector to the communications card; and (e) a plurality of contact wires disposed in said aperture, the contact wires forming an electrical connection between the communications card and the physical/electrical media connector disposed in the aperture, the contact wires having an initial contact surface and a remote end, the initial contact surface being broader than the remote end thereby preventing embedding and damage to the contact wires caused by plugging and unplugging the physical/electrical media connector in the aperture.

8. A communications card for use in a downsized computer as recited in claim 7, wherein the contact wires comprise a tapered section formed on the contact wires for preventing interface and damage to the contact wires.

9. A communications card for use in a downsized computer as recited in claim 8, wherein the contact wires have a length and the tapered section extends over a portion of the length thereof.

10. A communications card for use in a downsized computer as recited in claim 8, wherein:

(a) the contact wires computer the remote end disposed in the aperture; and (b) the contact wires further comprise the remote end of the contact wires being substantially rounded.

11. A communications card for use in a downsized computer as recited in claim 7, wherein the communications card is a local area network card.

12. A communications card for use in a downsized computer as recited in claim 7, wherein the communications card is a modem card.

13. A communications card for use in a downsized computer as recited in claim 7, further comprising means for preventing the passage of the physical/electrical media connector completely through the aperture in the detachable aperture block.

14. A communications card for use in a downsized computer as recited in claim 13, wherein the means for preventing the passage of the physical/electrical media connector completely through the aperture is a retention ledge.

15. A communications card for use in a downsized computer as recited in claim 13, wherein the means for preventing the passage of the physical/electrical media connector completely through the aperture in the detachable aperture block comprise a retention structure, the retention structure being mechanically biased to exert a force opposing insertion of the physical/electrical media connector.

16. A communications card having electrical components for use in connecting a downsized computer to a physical/electrical media connector of a communications systems, the communications card comprising:

(a) an upper surface;

(b) a lower surface, the lower surface separated from the upper surface by a distance smaller than a cross-section of the physical/electrical media connector, the electrical components of the communications card being positioned between the upper surface and the lower surface;

(c) an aperture block physically and electrically connected to the communications card between the upper surface and the lower surface;

(d) an aperture formed in the aperture block the aperture being sized and configured so as to directly receive at least a portion of the physical/electrical media connector to connect the physical/electrical media connector to the communications card; and (e) a plurality of contact wires disposed in said aperture, the contact wires forming an electrical connection between the communications card and the physical/electrical media connector disposed in the aperture, the contact wires comprising a tapered section having an initial contact surface and a remote end, the initial contact surface being broader than the remote end, thereby preventing embedding and damage to the contact wires by plugging and unplugging the physical/electrical media connector in the aperture.

17. A communications card for use in a downsized computer as recited in claim 16, wherein the contact wires have a length and the tapered section of the contact wires extends over a portion of the length thereof.

18. A communications card for use in a downsized computer as recited in claim 16 wherein:

(a) the contact wires comprise a remote end disposed in the aperture; and (b) the the contact wires further comprise the remote end of the contact wire being substantially rounded.

19. A communications card for use in a downsized computer as recited in claim 16, wherein the communications card is a local area network card.

20. A communications card for use in a downsized computer as recited in claim 16, wherein the communications card is a modem card.

21. A communications card for use in a downsized computer as recited in claim 16, further comprising means for preventing the passage of the physical/electrical media connector completely through the aperture in the retractable aperture block.

22. A communications card for use in a downsized computer as recited in claim 21, wherein the means for preventing the passage of the physical/electrical media connector completely through the aperture is a retention structure, the retention structure being mechanically biased to exert a force opposing the insertion of the physical/electrical media connector into the aperture.

23. A method for manufacturing an interface for use between a media connector and a communications card, the method comprising the steps:

(a) fixing a plurality of contact wires in an insert portion of a thin-architecture communications card, the contact wires extending outwardly from one end of the insert portion;

(b) forming an aperture in a thin-architecture communications card; and (c) incorporating the insert portion into a thin-architecture communications card so that the contact wires extend into the aperture, the contact wires having an initial contact surface and a remote end, the initial contact surface being broader than the remote end, thereby preventing damage to the contact wires when plugging and unplugging the media connector in the aperture.

24. A method for manufacturing an interface for use between a media connector and a communications card as recited in claim 23, wherein:

(a) the contact wires comprise the remote end disposed in the aperture; and (b) the contact wires further comprise the remote end of the contact wires being substantially rounded.

25. A method for manufacturing an interface for use between a media connector and a communications card as recited in claim 24, wherein the contact wires comprise a tapered section formed on the contact wires for preventing interface and damage to the contact wires.

26. A method for manufacturing an interface for use between a media connector and a communications card as recited in claim 25, wherein the communications card is a Local Area Network adaptor card.

27. A method for manufacturing an interface for use between a media connector and a communications card as recited in claim 25, wherein the communications card is a modem card.

* * * * *